US007237459B1

(12) United States Patent
Shiao

(10) Patent No.: US 7,237,459 B1
(45) Date of Patent: Jul. 3, 2007

(54) RATCHET SCREWDRIVER

(75) Inventor: Hsuan-Sen Shiao, No. 55, Cheng-Feng Lane, Tai-Ming Rd., Wu-Jih Hsiang (TW)

(73) Assignee: Hsuan-Sen Shiao, Wu-Jin Hsiang (TW)

( * ) Notice: Subject to any disclaimer, the term of this patent is extended or adjusted under 35 U.S.C. 154(b) by 0 days.

(21) Appl. No.: 11/436,773

(22) Filed: May 19, 2006

(51) Int. Cl.
*B25B 13/46* (2006.01)

(52) U.S. Cl. ..... 81/62; 81/63.1

(58) Field of Classification Search ..... 81/61, 81/62, 63.1; 192/43.1
See application file for complete search history.

(56) References Cited

U.S. PATENT DOCUMENTS 2,013,765 A * 9/1935 Richardson ..... 81/61
6,047,802 A * 4/2000 Huang ..... 81/63.1
6,658,970 B2 * 12/2003 Shiao ..... 81/62
6,854,363 B2 * 2/2005 Ping ..... 81/63.1
6,997,084 B1 * 2/2006 Gao et al. ..... 81/62
7,036,399 B1 * 5/2006 Gao et al. ..... 81/63.1
7,047,843 B1 * 5/2006 Huang ..... 81/63.1
2002/0194964 A1 * 12/2002 Huang ..... 81/62
2003/0110901 A1 * 6/2003 Shiao ..... 81/62
2007/0012142 A1 * 1/2007 Shiao ..... 81/62

* cited by examiner

*Primary Examiner*—D. S. Meislin
(74) *Attorney, Agent, or Firm*—Davidson Berquist Jackson & Gowdey

(57) ABSTRACT

A screwdriver includes a shaft fixed to a handle and having two first pawl-receiving grooves and two second pawl-receiving grooves. Two first pawl plates and two second pawl plates are disposed correspondingly in the first and second pawl-receiving grooves. Each of the first or second pawl plates has a swingable end movable between a first position, where the swingable end is biased to engage one ratchet tooth, and a second position, where the swingable end is released from the ratchet tooth. A switching ring sleeved on the shaft has actuators to move the respective first and second pawl plates to the second position.

6 Claims, 12 Drawing Sheets

RATCHET SCREWDRIVER

BACKGROUND OF THE INVENTION

1. Field of the Invention

The invention relates to a hand tool, more particularly to a ratchet screwdriver.

2. Description of the Related Art

Referring to FIGS. 1 and 2, a conventional ratchet screwdriver, as disclosed in Taiwanese Patent Publication No. 00369979, includes a handle 1, a main body 2, two substantially U-shaped pawls 201, two springs 202, an adjustment ring 3, and a ratchet wheel 4. The main body 2 is fixed to the handle 1, and has two parallel insert grooves 203 formed offset from the center of the main body 2. The pawls 201 are respectively inserted into the insert grooves 203. Each of the springs 202 is disposed between one of the insert grooves 203 and the corresponding pawl 201 so as to bias the pawl 201 away from the main body 2. The adjustment ring 3 is sleeved on the main body 2, and has two angularly spaced-apart indentations 302 formed in an inner peripheral face 301 thereof. Each indentation 302 has an inclined guide face 303. The ratchet wheel 4 is sleeved on the main body 2 adjacent to the adjustment ring 3, and has a plurality of teeth 402 formed circumferentially around an inner face of the ratchet wheel 4 to engage one of the corresponding pawls 201. When the adjustment ring 3 is rotated, each pawl 201 is guided by the inclined guide face 303 of the corresponding indentation 302 to change position.

Although the aforementioned conventional ratchet screwdriver can achieve its intended purpose, because only one side of each pawl 201 is meshed with the corresponding tooth 402 of the ratchet wheel 4, meshing forces between the pawls 201 and the corresponding teeth 402 are relatively weak, thereby resulting in an insufficient torque-bearing capacity of the ratchet screwdriver. Further, when the adjustment ring 3 is rotated, the pawls 201 can only move in a straight line relative to the main body 2. This may adversely affect the smooth operation of the adjustment ring 3.

Referring to FIGS. 3 and 4, another conventional ratchet screwdriver, as disclosed in Taiwanese Patent No. M269147, includes a handle 5, an actuator 6 fitted to the handle 5, two pairs of pawls 701 installed on the actuator 6, two springs 702 each disposed between a corresponding pair of the pawls 701, a control ring 8 sleeved on the actuator 6, and a ratchet wheel 9 disposed on one side of the control ring 8. Each of the pawls 701 is provided with a plurality of teeth 701'. The control ring 8 has a plurality of studs 801. The ratchet wheel 9 has a plurality of teeth 901. The teeth 701' of each pair of the pawls 701 mesh with the corresponding teeth 901 of the ratchet wheel 9 through biasing action of the corresponding spring 702. Hence, when the control ring 8 is rotated, the pawls 701 are pushed by the studs 801 so as to achieve changing of the positions of the pawls 701.

Although the aforementioned conventional ratchet screwdriver can achieve its intended purpose, to ensure that the teeth 701' of the pawls 701 can mesh accurately with the teeth 901 of the ratchet wheel 9, the pawls 701 are generally made by powder metallurgy, which results not only in high production costs, but also in structurally weak pawls 701. Further, the pawls 701 can only move in a straight line relative to the actuator 6, which may have an adverse effect on the smooth operation of the control ring 8.

SUMMARY OF THE INVENTION

Therefore, the object of the present invention is to provide a ratchet screwdriver that has movable components with good meshing forces created therebetween such that high levels of torque may be applied to a workpiece, that utilizes simple shapes and structures of components to thereby have a low production cost, and that has a strong structure.

According to this invention, a ratchet screwdriver comprises a handle, a shaft, a ratchet wheel unit, a pawl unit, two spring elements, and a switching ring. The shaft is fixed to the handle, and includes an imaginary plane extending axially through an axis of the shaft, a circumferential face, two first pawl-receiving grooves formed respectively and symmetrically in the shaft on two sides of the imaginary plane, two second pawl-receiving grooves formed respectively and symmetrically in the shaft on two sides of the imaginary plane, and two spring-receiving recesses formed in the shaft on two sides of the imaginary plane respectively and each communicating with one of the first pawl-receiving grooves and one of the second pawl-receiving grooves. Each of the first and second pawl-receiving grooves has a groove opening formed in the circumferential face, and a groove bottom opposite to the groove opening. The groove opening is wider than the groove bottom in an angular direction. The ratchet wheel unit is sleeved rotatably on the shaft, and includes a wheel portion having a plurality of teeth disposed around the circumferential face, and a tool-coupling portion projecting from the wheel portion opposite to the handle. The pawl unit includes two first pawl plates disposed respectively in the first pawl-receiving grooves, and two second pawl plates mounted respectively in the second pawl-receiving grooves. Each of the first and second pawl plates has a retaining end and a swingable end extending respectively to the groove bottom and the groove opening of one of the first and second pawl-receiving grooves. The swingable end of each of the first and second pawl plates is swingable within a limited angle defined by the groove opening so as to move between first and second positions. In the first position, the swingable end engages one of the teeth. In the second position, the swingable end is released from said one of the teeth.

The spring elements are disposed respectively in the spring-receiving recesses. Each of the spring elements has two opposite ends urging respectively the swingable ends of one of the first pawl plates and one of the second pawl plates to move to the first positions of the swingable ends. The switching ring is sleeved on the shaft between the handle and the ratchet wheel, and has a plurality of actuators each moving a respective one of the first and second pawl plates to the second position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
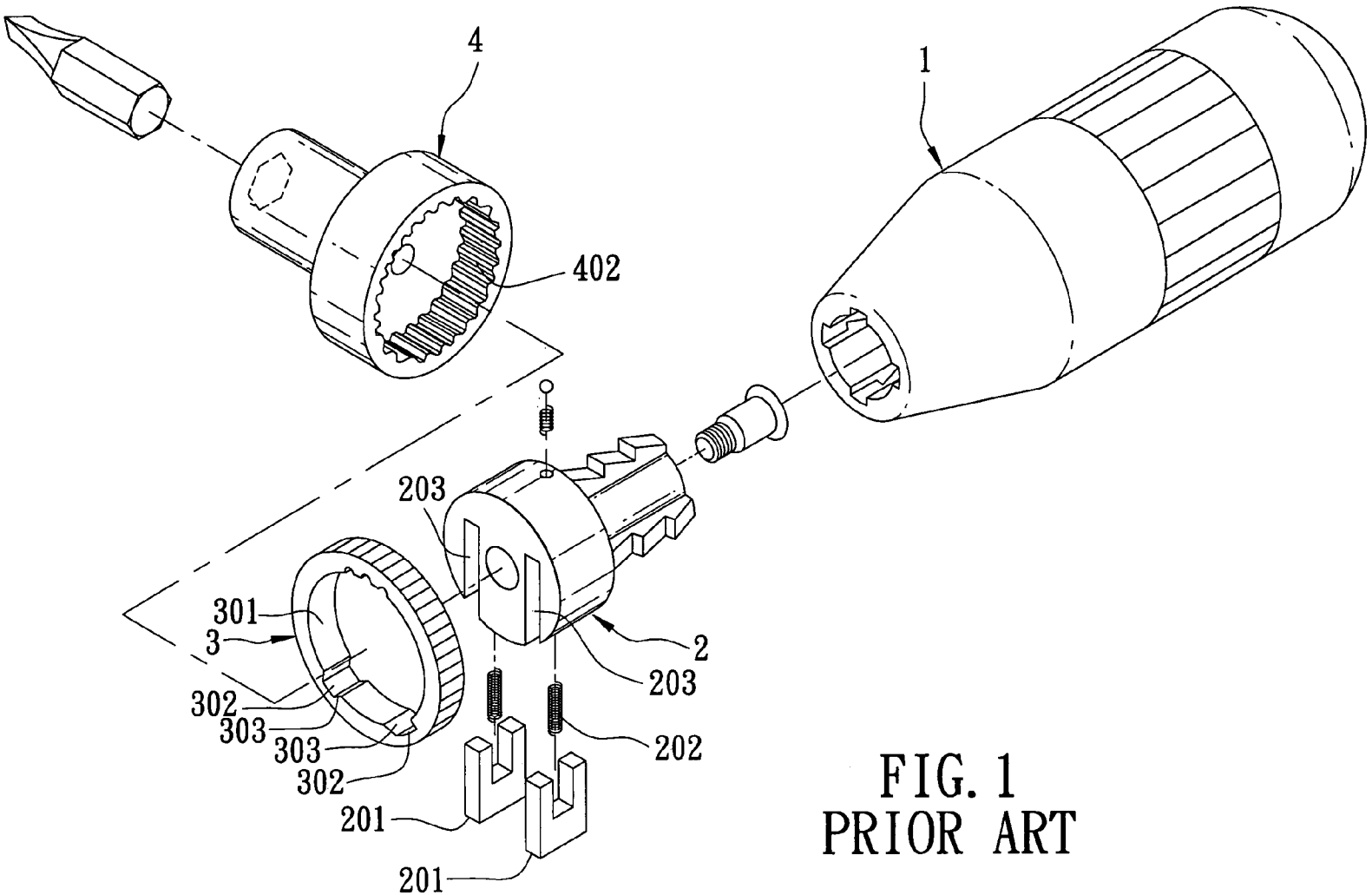
FIG. 1 PRIOR ART
FIG. 1 is an exploded perspective view of a conventional ratchet screwdriver as disclosed in Taiwanese Patent Publication No. 00369979.
Figure 2:
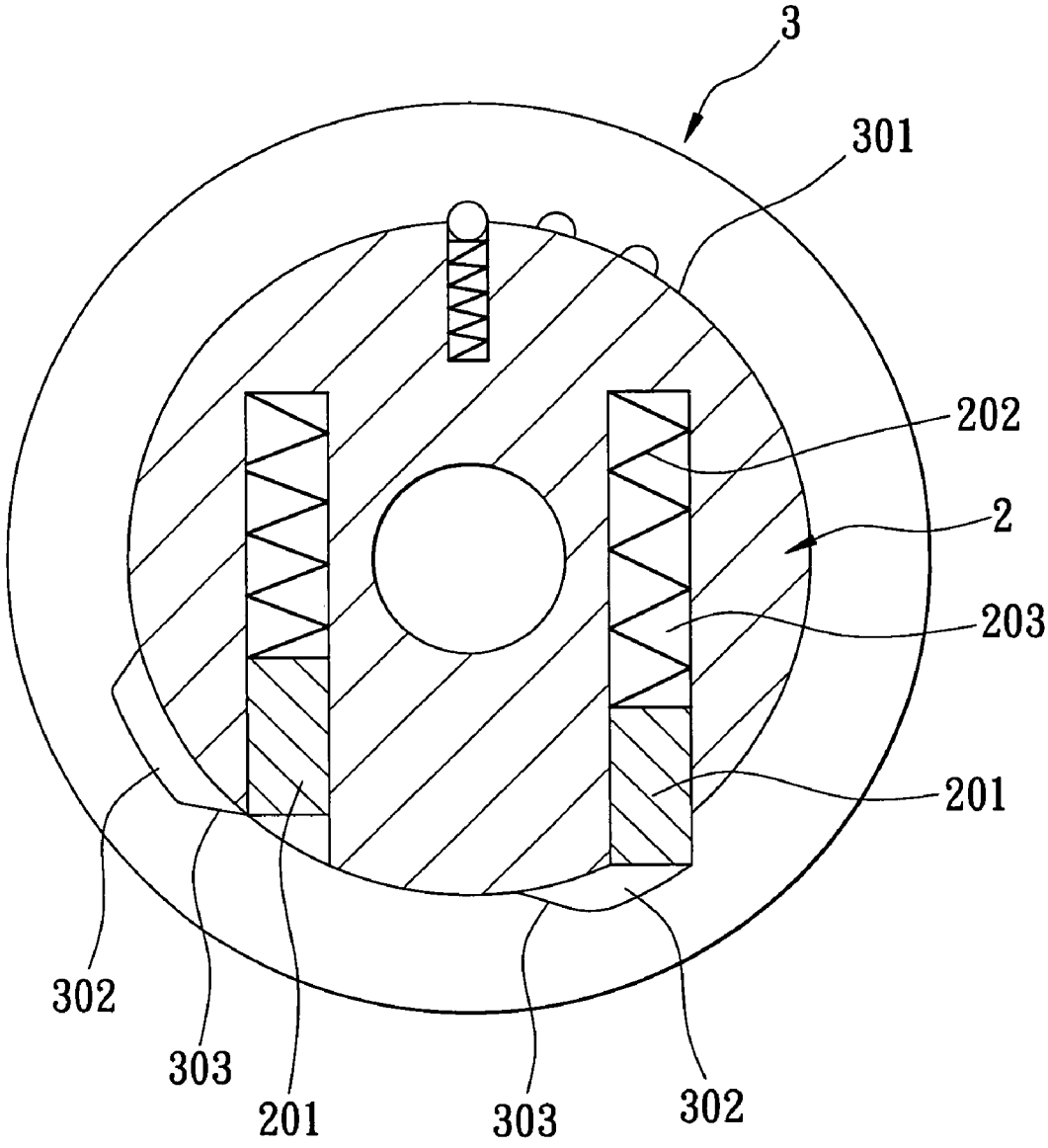
FIG. 2 PRIOR ART
FIG. 2 is a sectional view of the ratchet screwdriver of FIG. 1 in an assembled state.
Figure 3:
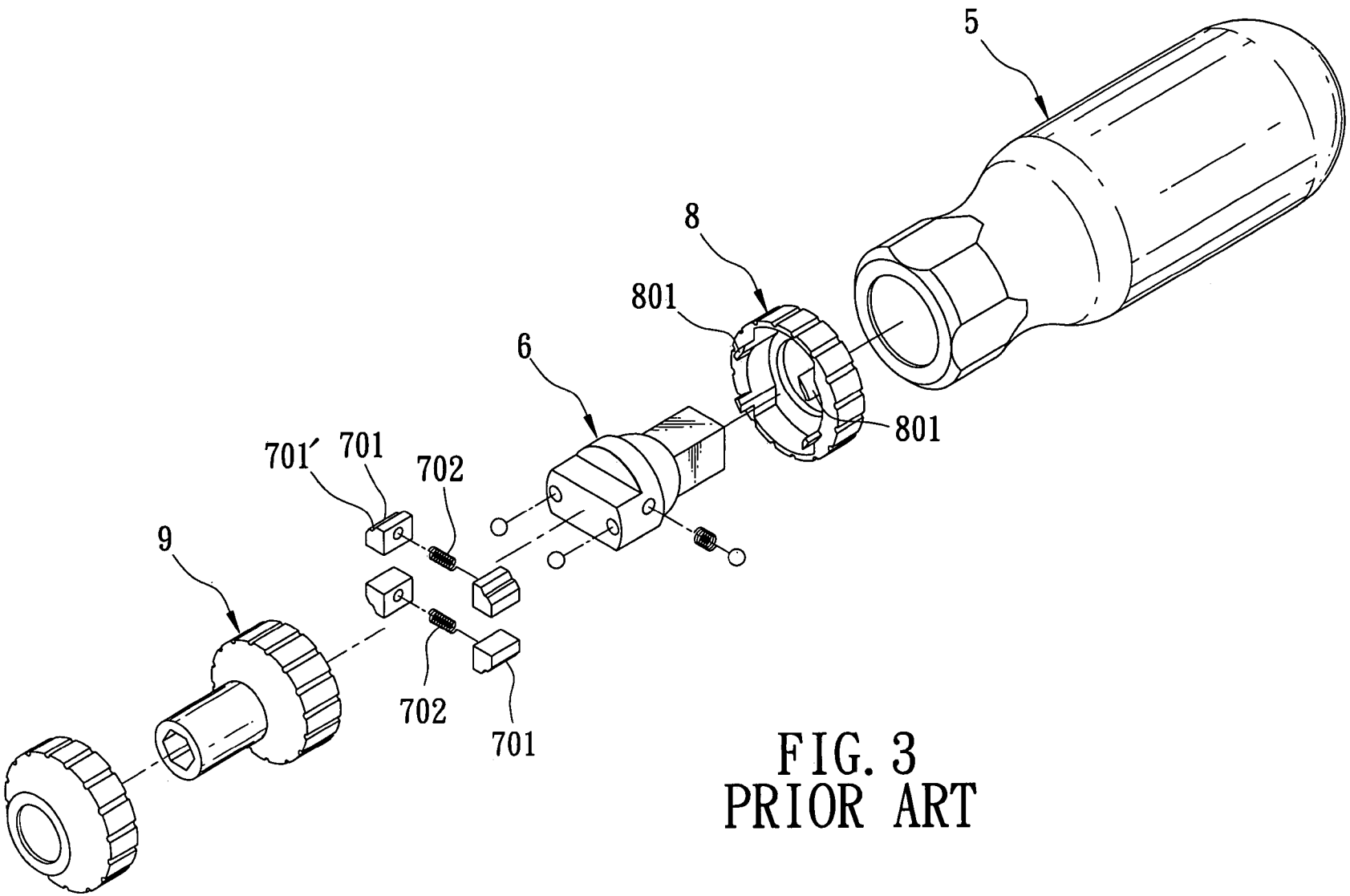
FIG. 3 PRIOR ART
FIG. 3 is an exploded perspective view of a conventional ratchet screwdriver as disclosed in Taiwanese Patent No. M269147.
Figure 4:
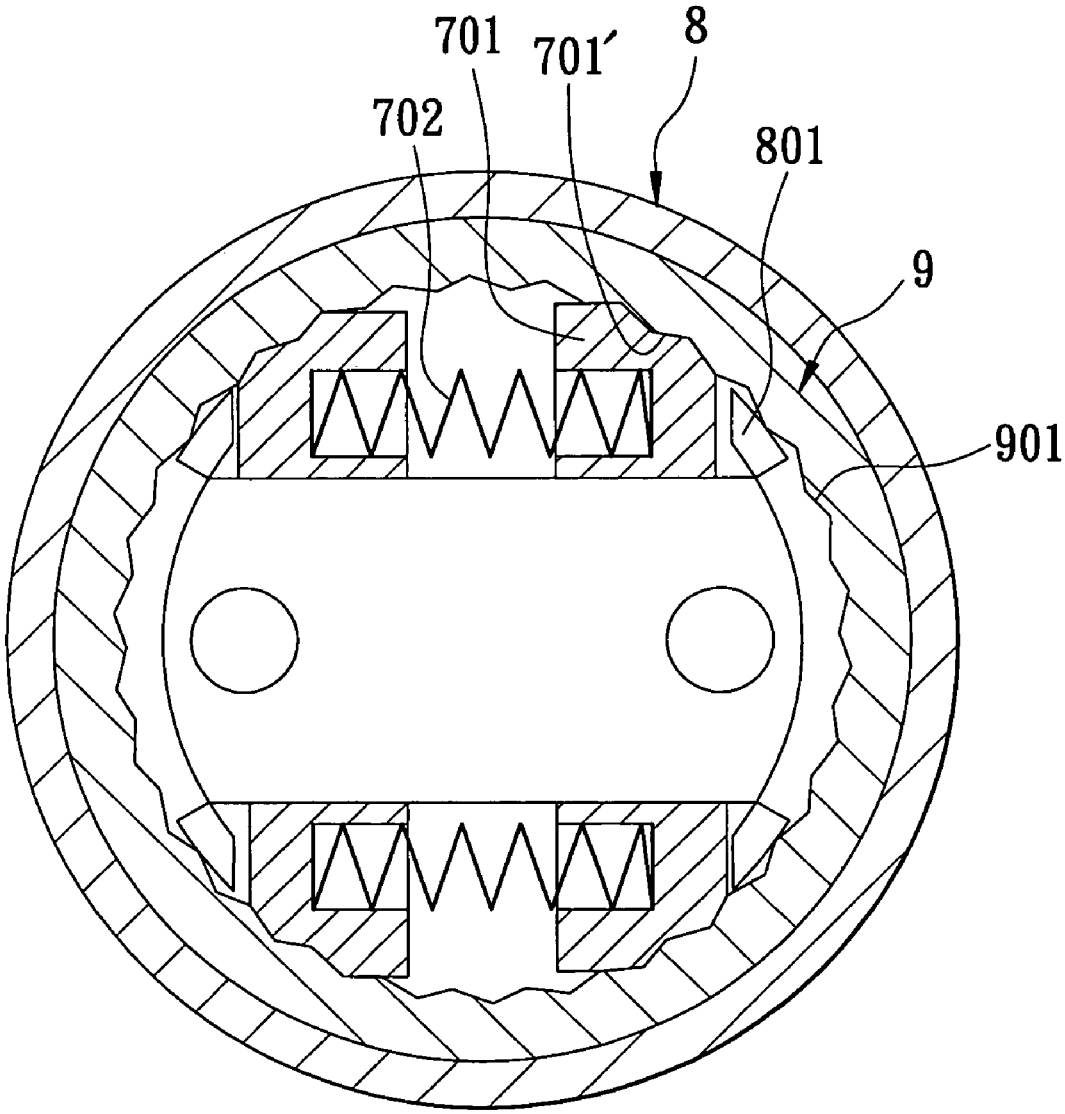
FIG. 4 PRIOR ART
FIG. 4 is a sectional view of the ratchet screwdriver of FIG. 3 in an assembled state.
Figure 5:
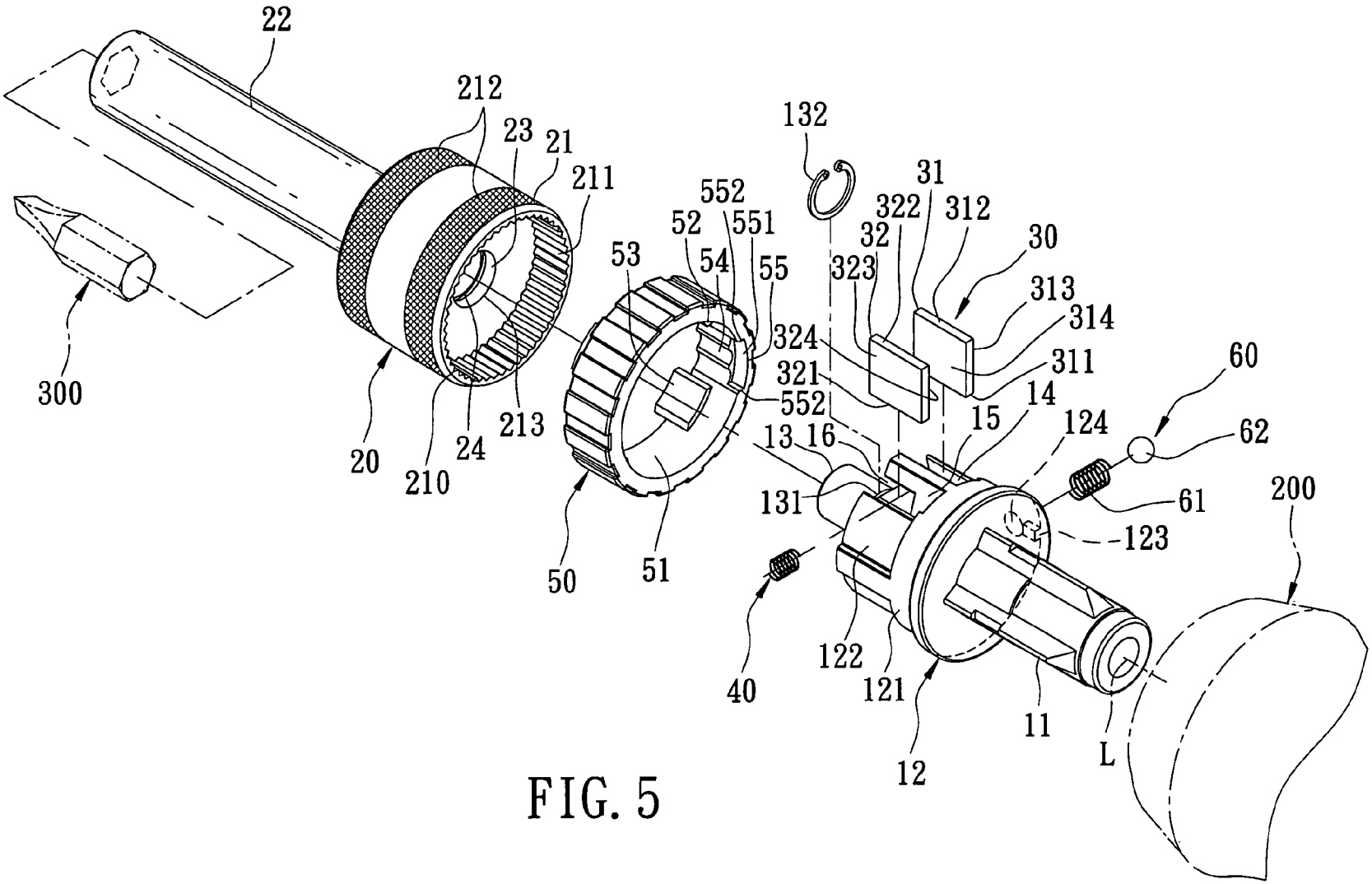
FIG. 5 is a fragmentary exploded perspective view of the preferred embodiment of a ratchet screwdriver according to the present invention.

Referring to FIGS. 5 to 12, the preferred embodiment of a ratchet screwdriver according to the present invention is shown to comprise a handle 200, a shaft 12, a ratchet wheel unit 20, a pawl unit 30, two spring elements 40, a switching ring 50, and a positioning unit 60.

The shaft 12 is fixed to the handle 200, and has a circumferential face 121, an engaging piece 123 projecting outwardly from the circumferential face 121, a slot 124 formed adjacent to the engaging piece 123, and four angularly spaced-apart notches 122 formed in the circumferential face 121. The shaft 12 further includes an imaginary plane (L') (see FIGS. 7 and 8) extending axially through an axis (L) of the shaft 12, an insert portion 11, a rod portion 13, two first pawl-receiving grooves 14, two second pawl-receiving grooves 15, and two spring-receiving recesses 16.

The insert portion 11 extends axially on one side of the shaft 12, and is inserted into the handle 200.

The rod portion 13 extends axially from the shaft 12 opposite to the insert portion 11, and has a cross section smaller than that of the shaft 12. The rod portion 13 further has an annular groove 131, and a substantially C-shaped ring 132 received in the annular groove 131.

The first pawl-receiving grooves 14 are formed respectively and symmetrically in the shaft 12 on two sides of the imaginary plane (L'), and are located substantially at two diametrically opposed positions. Each of the first pawl-receiving grooves 14 has a groove opening 144 formed in the circumferential face 121, a groove bottom 141 opposite to the groove opening 144, and first and second groove walls 142, 143 extending between the groove opening 144 and the groove bottom 141. The groove opening 144 is wider than the groove bottom 141 in an angular direction.

The second pawl-receiving grooves 15 are formed respectively and symmetrically in the shaft 12 on two sides of the imaginary plane (L'), and are located substantially at two diametrically opposed positions. Each of the second pawl-receiving grooves 15 has a groove opening 154 formed in the circumferential face 121, a groove bottom 151 opposite to the groove opening 154, and first and second groove walls 152, 153 extending between the groove opening 154 and the groove bottom 151. The groove opening 154 is wider than the groove bottom 151 in an angular direction. Two of the notches 122 communicate correspondingly with the groove openings 144 of the first pawl-receiving grooves 14, while the other two of the notches 122 communicate correspondingly with the groove openings 154 of the second pawl-receiving grooves 15.

The spring-receiving recesses 16 are formed in the shaft 12 respectively on two sides of the imaginary plane (L'). Each of the spring-receiving recesses 16 communicates with one of the first pawl-receiving grooves 14 and one of the second pawl-receiving grooves 15 (see FIG. 7).

The ratchet wheel unit 20 is sleeved rotatably on the shaft 12, and includes a wheel portion 21 and a tool-coupling portion 22. The wheel portion 21 has a first inner peripheral wall 210, and a second inner peripheral wall 213 having a cross section smaller than that of the first inner peripheral wall 210. The first inner peripheral wall 210 has a plurality of teeth 211 formed circumferentially thereon and disposed around the circumferential face 121 of the shaft 12. The second inner peripheral wall 213 defines an axial hole 23, and has an annular engaging groove 24 communicating with the axial hole 23. The rod portion 13 of the shaft 12 extends into the axial hole 23 with the C-shaped ring 132 engaging the annular engaging groove 24 so as to prevent axial movement or removal of the ratchet wheel unit 20 from the shaft 12 while permitting rotation of the ratchet wheel unit 20 relative to the shaft 12. The wheel portion 21 further has an outer peripheral wall provided with two spaced-apart annular knurled surfaces 212.

The tool-coupling portion 22 projects from the wheel portion 21 opposite to the handle 200, and is adapted to be connected with a tool bit 300.

The pawl unit 30 includes two first pawl plates 31 inserted respectively into the first pawl-receiving grooves 14, and two second pawl plates 32 inserted respectively into the second pawl-receiving grooves 15. Each of the first and second pawl plates 31, 32 has a rectangular cross section, a retaining end 311, 321 extending into the groove bottom 141, 151 of one of the first and second pawl-receiving grooves 14, 15, a swingable end 312, 322 opposite to the retaining end 311, 321 and extending into the groove opening 144, 154 of the corresponding one of the first and second pawl-receiving grooves 14, 15, a first face 313, 323 connected between the retaining end 311, 321 and the swingable end 312, 322 and facing the first groove wall 142, 152 of the corresponding one of the first and second pawl-receiving grooves 14, 15, and a second face 314, 324 opposite to the first face 313, 323 and facing the second groove wall 143, 153 of the corresponding one of the first and second pawl-receiving grooves 14, 15. The swingable end 312, 322 of each of the first and second pawl plates 31, 32 is swingable within a limited angle defined by the groove opening 144, 154 so as to move between a first position and a second position. In the first position, the swingable end 312, 322 engages the respective one of the teeth 211 of the wheel portion 21. In the second position, the swingable end 312, 322 is released from the respective one of the teeth 211 of the wheel portion 21.

The spring elements 40 are disposed respectively in the spring-receiving recesses 16 of the shaft 12. Each spring element 40, as best shown in FIG. 7, has two opposite ends abutting against a respective one of the first pawl plates 31 and the corresponding one of the second pawl plates 32 for urging respectively the swingable ends 312, 322 of one of the first pawl plates 31 and one of the second pawl plates 32 to move to the first positions.

The switching ring 50 is sleeved on the shaft 12, and is located between the handle 200 and the wheel portion 21 of the ratchet wheel unit 20. The switching ring 50 has an inner peripheral face 51, two first actuators 52 that are spaced apart from each other substantially by 180° and that are formed as protrusions which project respectively from the inner peripheral face 51 toward the corresponding notches 122 of the shaft 12 to move the first pawl plates 31 to their second positions, two second actuators 53 that are spaced apart from each other substantially by 180° and that are formed as protrusions which project respectively from the inner peripheral face 51 toward the corresponding notches 122 of the shaft 12 to move the second pawl plates 32 to their second positions, three angularly disposed recesses 54 which are formed successively in the inner peripheral face 51, and a limiting groove 55 extending inwardly from the inner peripheral face 51 and provided between one of the first actuators 52 and the corresponding one of the second actuators 53 to receive the engaging piece 123 of the shaft 12. The engaging piece 123 is slidable angularly and limitedly within the limiting groove 55. The limiting groove 55 is defined by a groove bottom 551 and two sidewalls 552 that extend outwardly and respectively from two opposite ends of the groove bottom 551 toward the inner peripheral face 51. Each of the protrusions 52, 53 is slidable circumferentially in one of the notches 122 to push angularly the swingable end 312, 322 of a corresponding one of the first and second pawl plates 31, 32 to the second position.

The positioning unit 60 is provided for positioning the switching ring 50, and includes a spring 61 disposed in the slot 124 of the shaft 12, and a roller 62 disposed in the slot 124 and biased by the spring 61 to engage resiliently one of the recesses 54.

Figure 6:
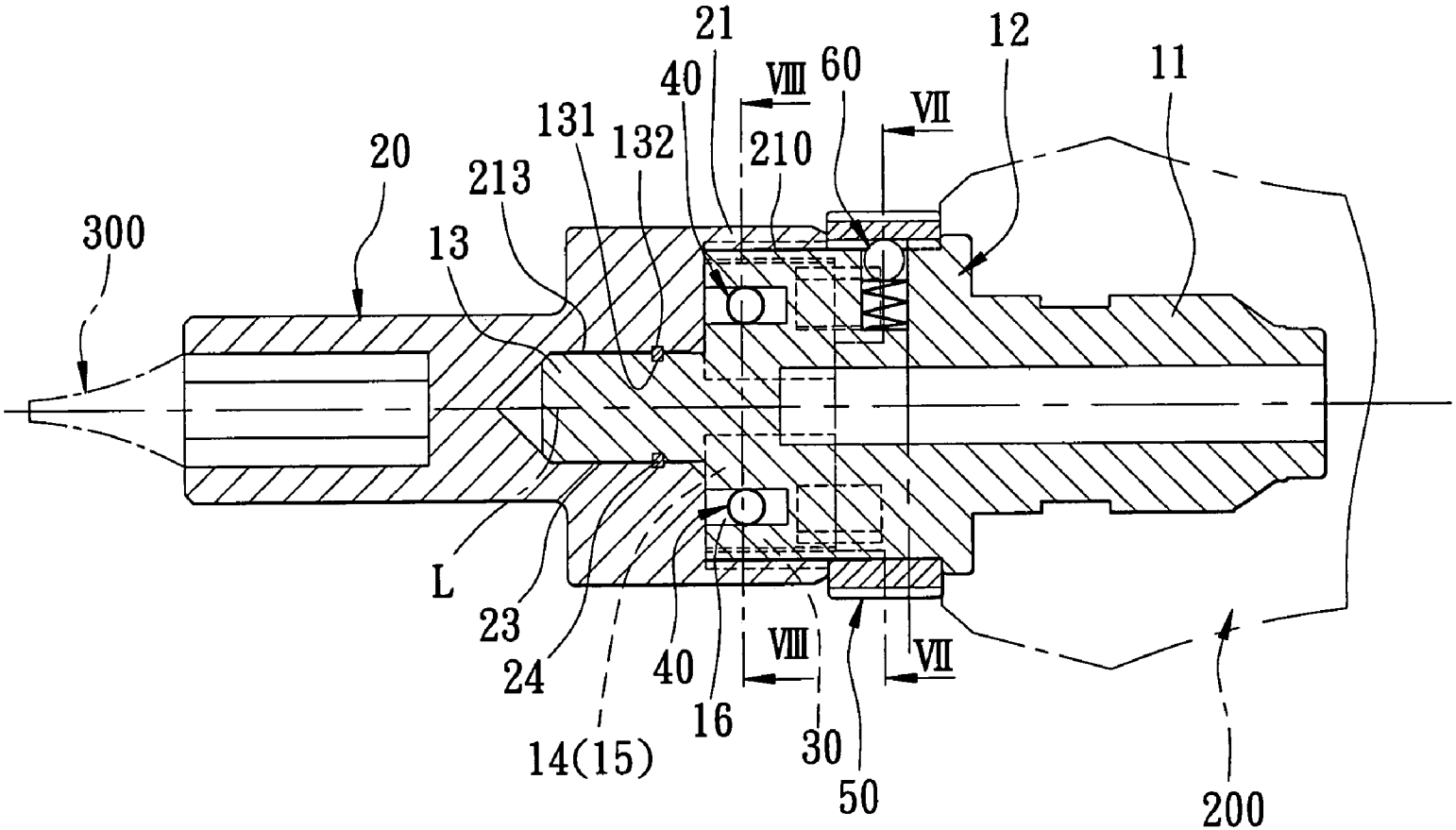
FIG. 6 is a fragmentary sectional view of the preferred embodiment in an assembled state.
Figure 7:
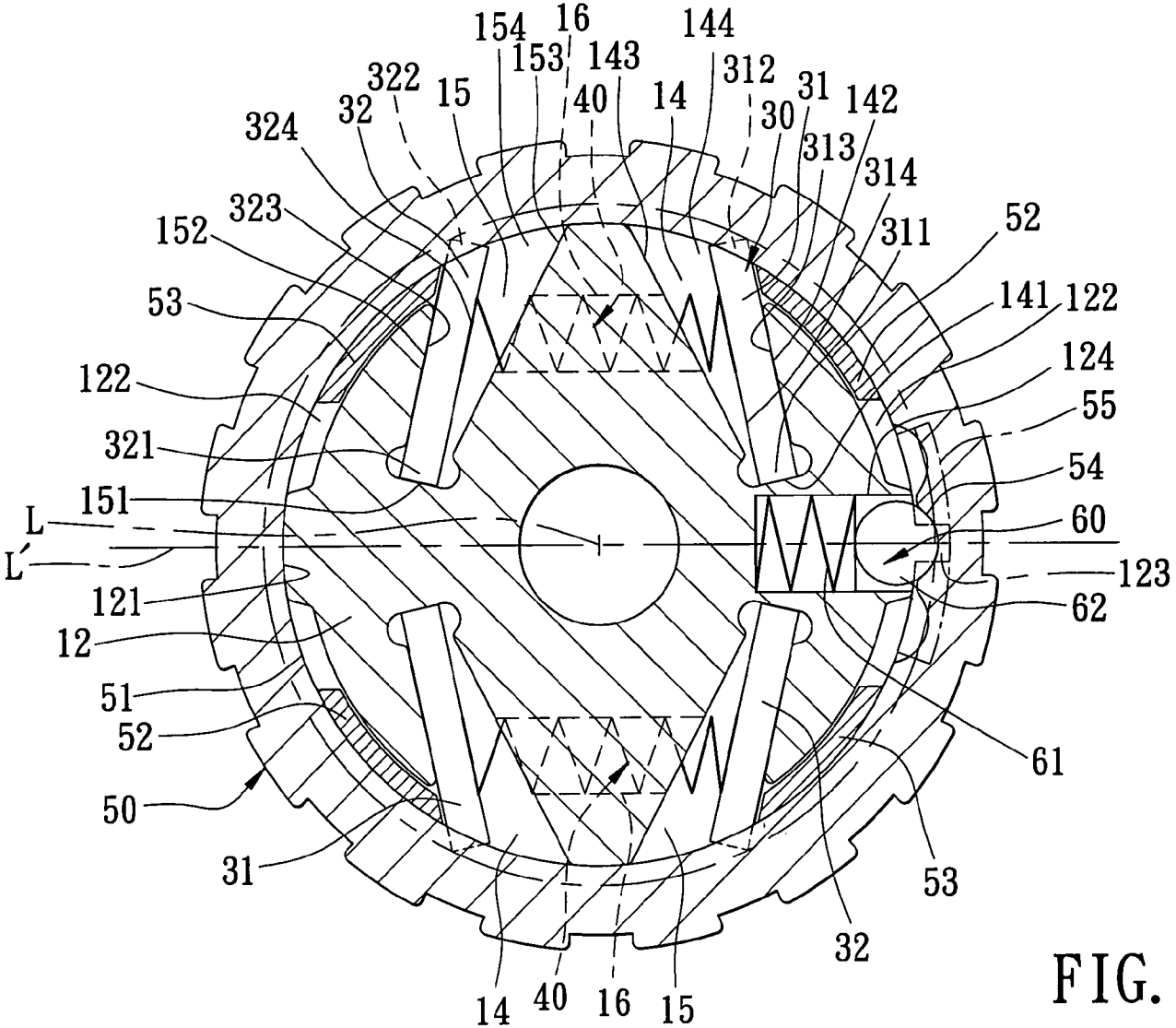
FIG. 7 is a sectional view of the preferred embodiment taken along line VII-VII of FIG. 6.
Figure 8:
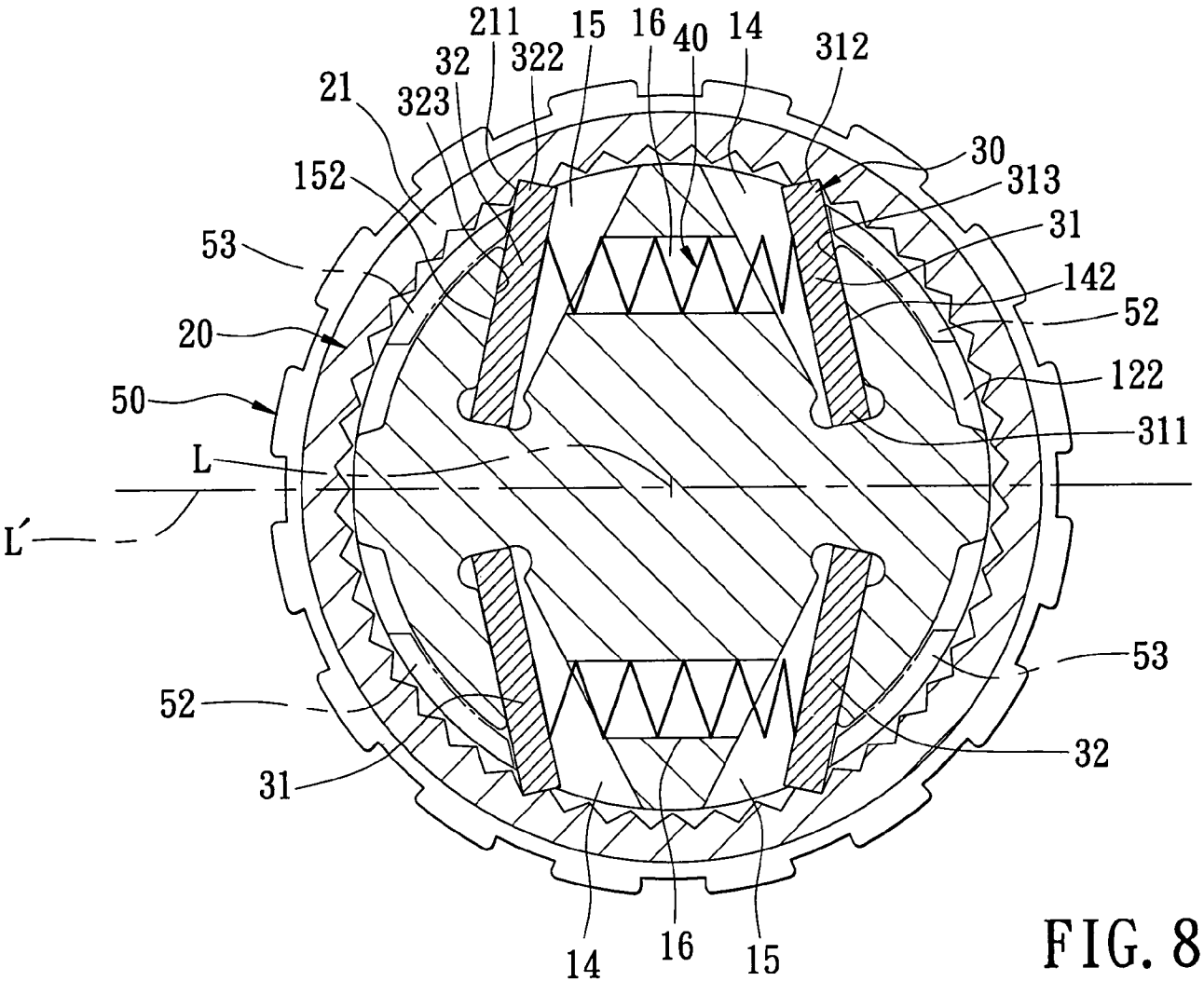
FIG. 8 is a sectional view of the preferred embodiment taken along line VIII-VIII of FIG. 6.

With reference to FIGS. 6, 7, and 8, after assembly of the aforementioned components of the present invention, through engagement of the C-shaped ring 132 with the annular engaging groove 24, the ratchet wheel unit 20 is positioned on the shaft 12, and the switching ring 50 is positioned between the wheel portion 21 of the ratchet wheel unit 20 and the handle 200. When the switching ring 50 is rotated to a middle blocking position, where the engaging piece 123 is located at the center of the limiting groove 55 and the roller 62 engages a middle one of the recesses 54, the first and second actuators 52, 53 do not push the first and second pawl plates 31, 32, so that the swingable ends 312, 322 of the first and second pawl plates 31, 32 are urged by the spring elements 40 to mesh with the corresponding teeth 211 of the wheel portion 21 and so that the swingable ends 312, 322 are positioned in the first position. At this time, the first faces 313, 323 of the first and second pawl plates 31, 32 abut respectively against the first groove walls 142, 152 of the first and second pawl-receiving grooves 14, 15. When the handle 200 is rotated, the shaft 12 and the tool bit 300 can be rotated synchronously either in a clockwise direction or in a counterclockwise direction.

Figure 9:
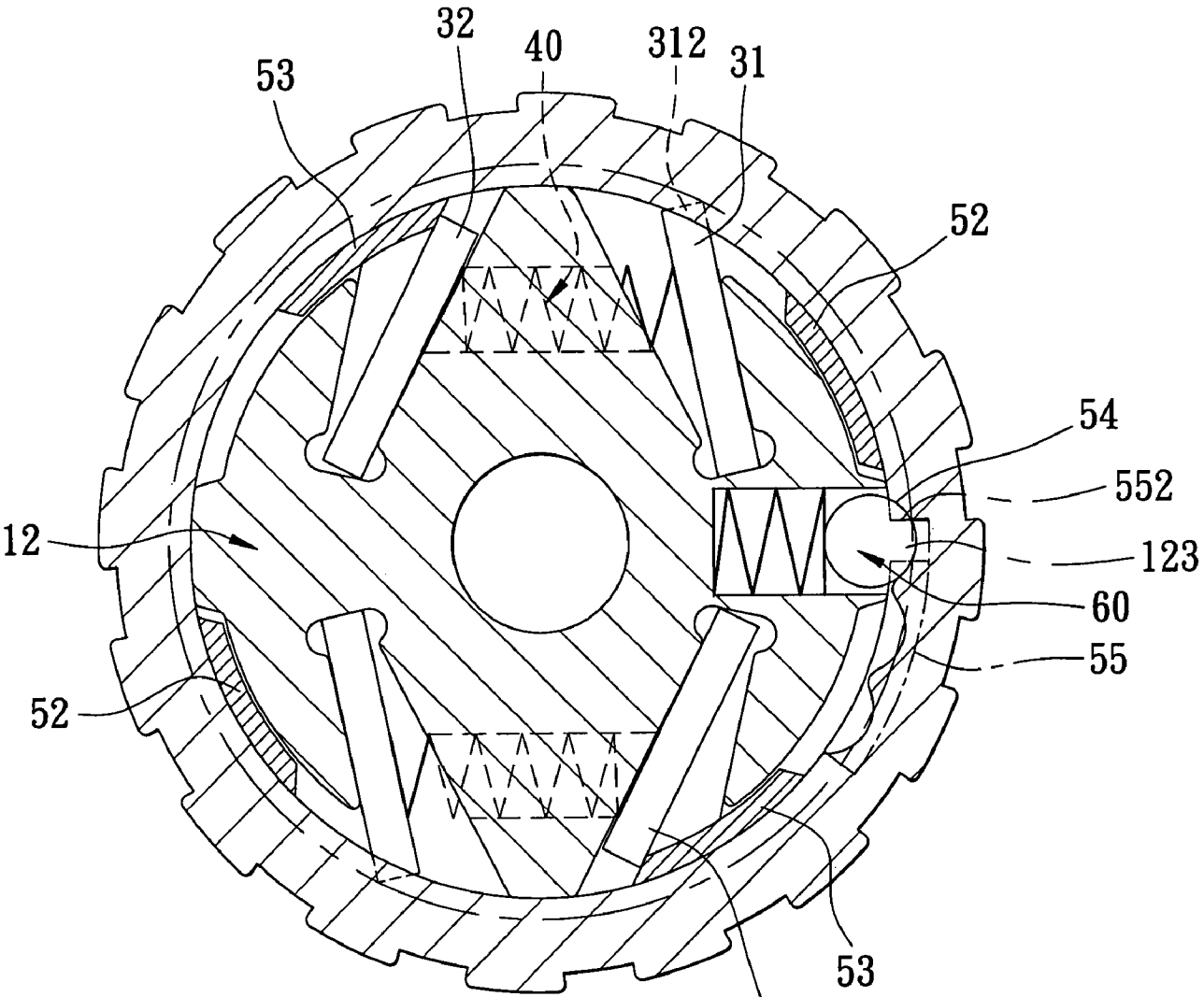
FIG. 9 is a view similar to FIG. 7, but illustrating two second pawl plates in another position.
Figure 10:
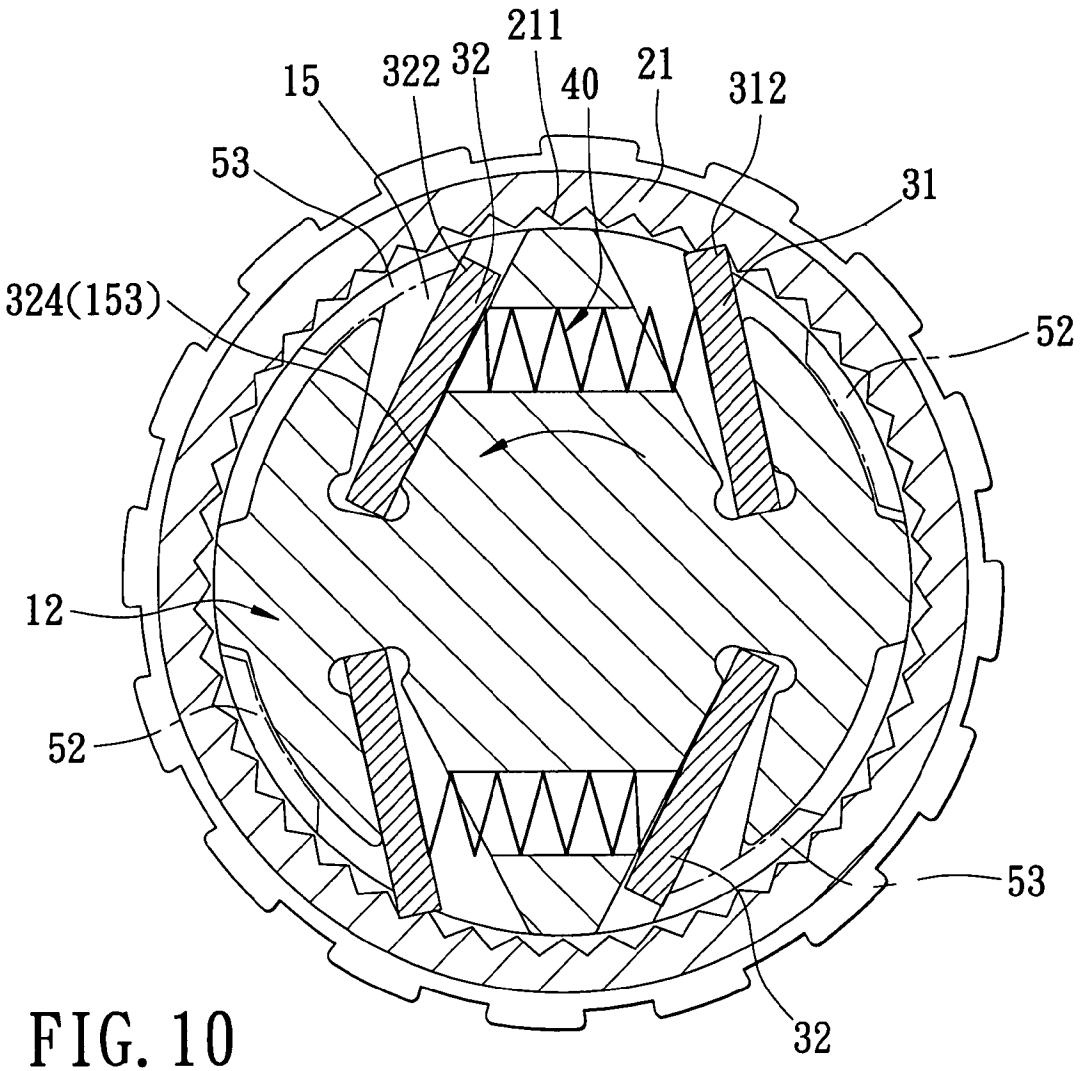
FIG. 10 is a view similar to FIG. 8, but illustrating two second pawl plates disengaged from the corresponding teeth of a ratchet wheel unit.

When the switching ring 50 is rotated in a clockwise direction, the roller 62 of the positioning unit 60 engages a topmost one of the recesses 54, and the engaging piece 123 abuts against one of the sidewalls 552 of the limiting groove 55, as best shown in FIG. 9. Consequently, the swingable ends 322 of the second pawl plates 32 are pushed by the respective second actuators 53 to the second position, i.e., the swingable ends 322 of the second pawl plates 32 are released from the corresponding teeth 211 of the ratchet wheel unit 20. The second faces 324 of the second pawl plates 32 abut against the second groove walls 153 of the respective second pawl-receiving grooves 15 at this time, as best shown in FIG. 10. Because the first actuators 52 do not push the respective first pawl plates 31, the swingable ends 312 of the first pawl plates 31 are still in meshing contact with the corresponding teeth 211 of the ratchet wheel unit 20 through the biasing forces of the spring elements 40 (see FIG. 10). When the handle 200 is rotated in a counter clockwise direction, the shaft 12 and the tool bit 300 rotate synchronously in the counterclockwise direction. However, the handle 200 idles when rotated clockwise.

Figure 11:
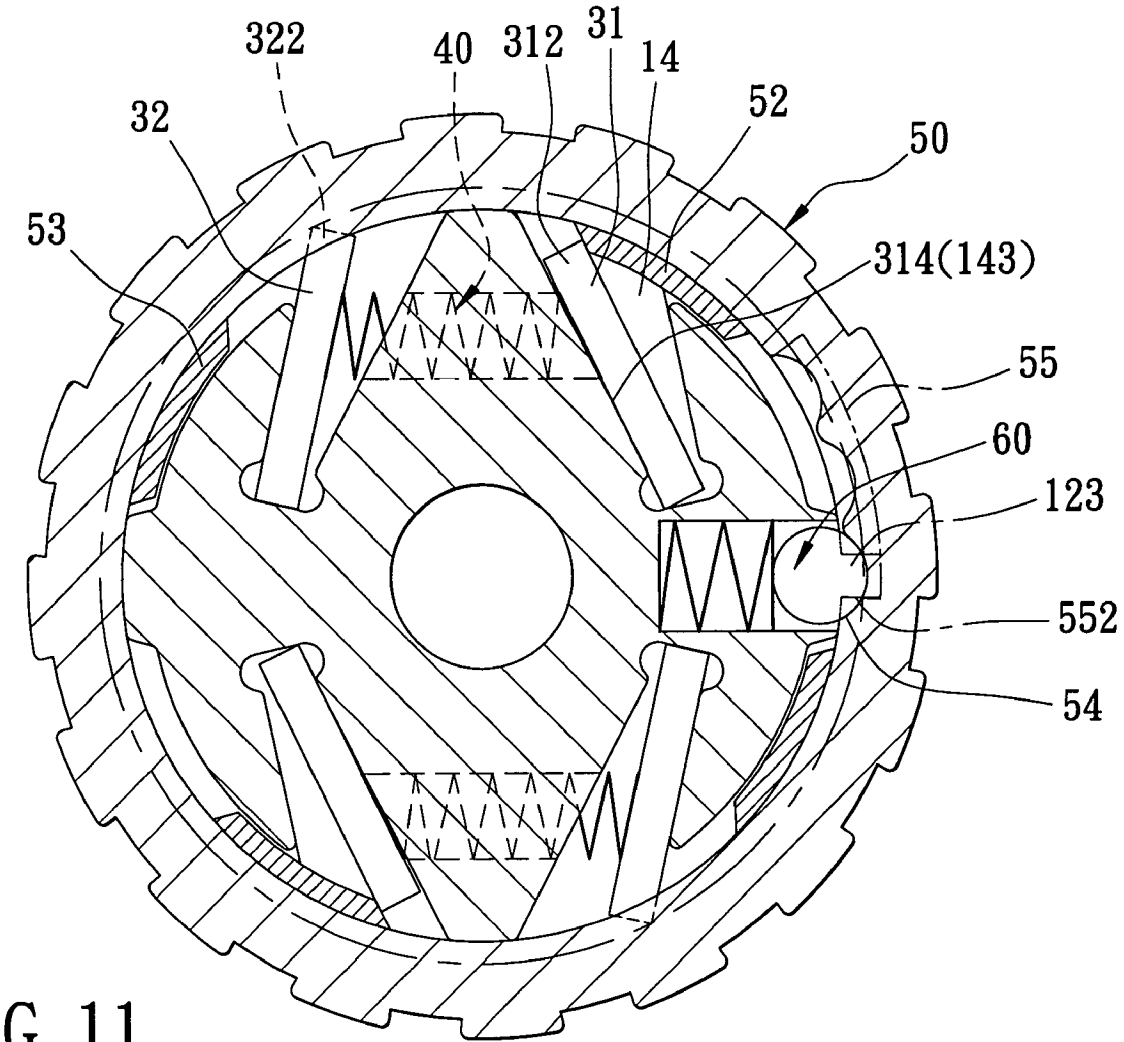
FIG. 11 is a view similar to FIG. 7, but illustrating two first pawl plates in another position.
Figure 12:
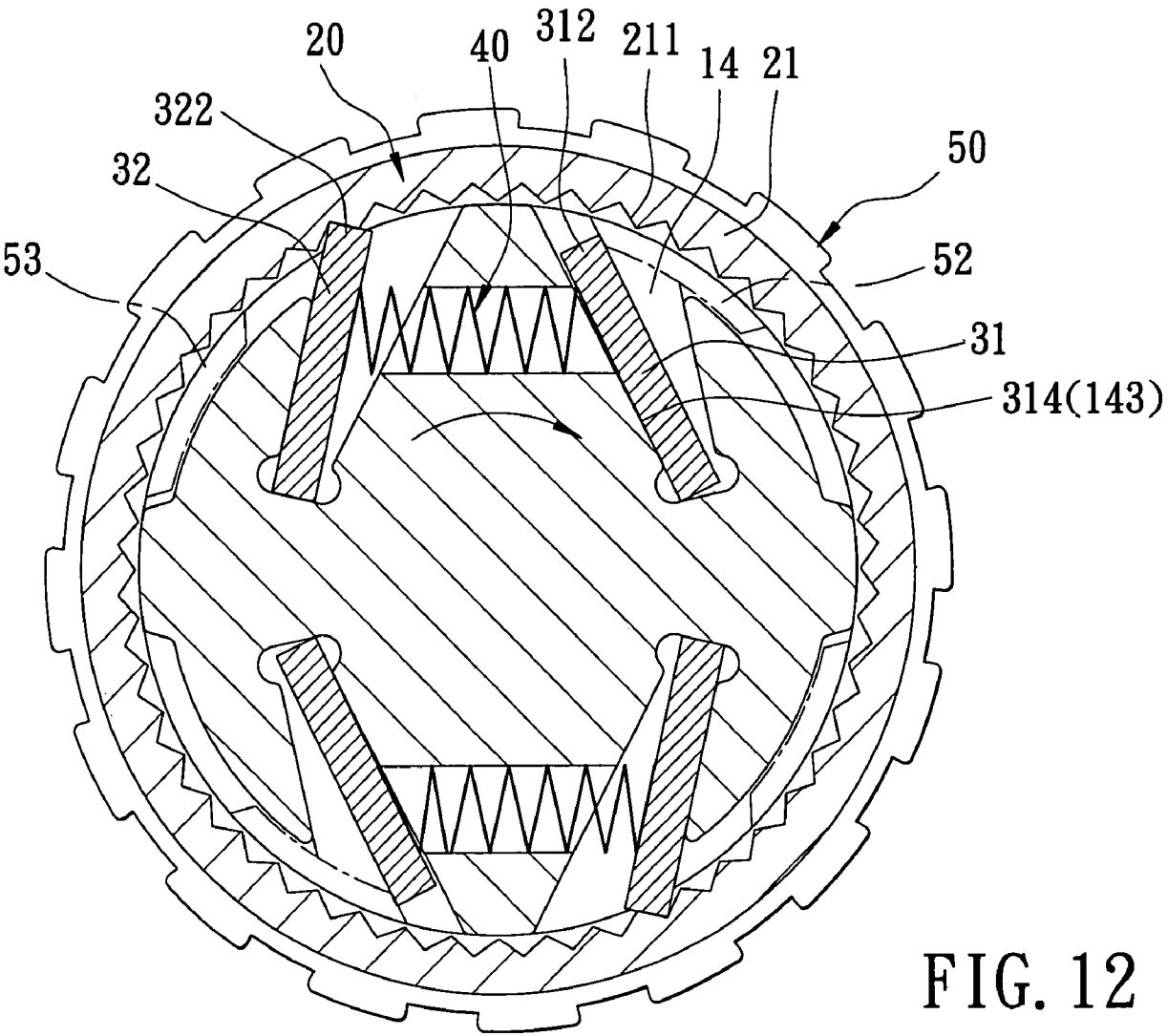
FIG. 12 is a view similar to FIG. 8, but illustrating the two first pawl plates disengaged from the corresponding teeth of the ratchet wheel unit.

When the switching ring 50 is rotated in a counterclockwise direction, the roller 62 of the positioning unit 60 engages a bottommost one of the recesses 54, and the engaging piece 123 abuts against the other one of the sidewalls 552 of the limiting groove 55, as best shown in FIG. 11. Consequently, the swingable ends 312 of the first pawl plates 31 are pushed by the respective first actuators 52 to the second position, i.e., the swingable ends 312 of the first pawl plates 31 are removed from the corresponding teeth 211 of the ratchet wheel unit 20. The second faces 314 of the first pawl plates 31 abut against the second groove walls 143 of the respective first pawl-receiving grooves 14 at this time, as best shown in FIG. 12. Because the second actuators 53 are located away from the respective second pawl plates 32 (see FIG. 12), the swingable ends 322 of the second pawl plates 32 are still in meshing contact with the corresponding teeth 211 of the ratchet wheel unit 20 through the biasing forces of the spring elements 40. When the handle 200 is rotated in a clockwise direction, the shaft 12 and the tool bit 300 rotate synchronously in the clockwise direction. However, the handle 200 idles when rotated counterclockwise.

The advantages of the present invention can be summarized as follows:

1. Because one of the first pawl plates 31 and one of the second pawl plates 32 are provided on each side of the imaginary plane (L') of the shaft 12, the swingable ends 312, 322 of the first and second pawl plates 31, 32 mesh with the corresponding teeth 211 of the ratchet wheel unit 20 on two sides of the imaginary plane (L') of the shaft 12. Hence, the ratchet screwdriver of the present invention possesses a large torque-bearing capacity.

2. The configuration of the first and second pawl plates 31, 32 is simple and structurally strong. Hence, the first and second pawl plates 31, 32 can be manufactured easily at a minimum cost, and will not easily fail.

3. By rotating the switching ring 50, the first and second pawl plates 31, 32 can be moved relative to the shaft 12, so that the ratchet screwdriver of the present invention can be operated smoothly.

It should be noted that if a small fastening force is required, the user can directly rotate the ratchet wheel unit 20 by utilizing the knurled surfaces 212 provided on the outer peripheral wall of the wheel portion 21, so that a screw can be fastened quickly, thereby enhancing work efficiency.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A ratchet screwdriver comprising:

a handle;

a shaft fixed to said handle and including an imaginary plane extending axially through an axis of said shaft, a circumferential face, two first pawl-receiving grooves formed respectively and symmetrically in said shaft on two sides of said imaginary plane, two second pawl-receiving grooves formed respectively and symmetrically in said shaft on two sides of said imaginary plane, and two spring-receiving recesses formed in said shaft on two sides of said imaginary plane, respectively, and each communicating with one of said first pawl-receiving grooves and one of said second pawl-receiving grooves, each of said first and second pawl-receiving grooves having a groove opening formed in said circumferential face, and a groove bottom opposite to said groove opening, said groove opening being wider than said groove bottom in an angular direction;

a ratchet wheel unit sleeved rotatably on said shaft, and including a wheel portion having a plurality of teeth disposed around said circumferential face, and a tool-coupling portion projecting from said wheel portion opposite to said handle;

a pawl unit including two first pawl plates disposed respectively in said first pawl-receiving grooves, and two second pawl plates mounted respectively in said second pawl-receiving grooves, each of said first and second pawl plates having a retaining end and a swingable end extending respectively to said groove bottom and said groove opening of one of said first and second pawl-receiving grooves, said swingable end of each of said first and second pawl plates being swingable within a limited angle defined by said groove opening so as to move between a first position, where said swingable end engages one of said teeth, and a second position, where said swingable end is released from said one of said teeth;

two spring elements disposed respectively in said spring-receiving recesses, each of said spring elements having two opposite ends urging respectively said swingable ends of one of said first pawl plates and one of said second pawl plates to move to said first positions of said swingable ends; and a switching ring sleeved on said shaft between said handle and said wheel portion, and having a plurality of actuators each moving a respective one of said first and second pawl plates to said second position.

2. The ratchet screwdriver of claim 1, further comprising a positioning unit for positioning said switching ring, said positioning unit including a spring disposed in said shaft, and a roller disposed in said shaft and biased by said spring to move to said switching ring.

3. The ratchet screwdriver of claim 2, wherein said switching ring has an inner peripheral face formed with a plurality of angularly disposed recesses which are adjacent to each other, said roller being biased by said spring to engage resiliently one of said recesses.

4. The ratchet screwdriver of claim 3, wherein said shaft further has an engaging piece projecting from said circumferential face, said switching ring further having a limiting groove extending inwardly from said inner peripheral face to receive said engaging piece, said engaging piece being slidable angularly and limitedly within said limiting groove.

5. The ratchet screwdriver of claim 1, wherein said shaft further has a plurality of angularly spaced-apart notches each formed in said circumferential face of said shaft and communicated with said groove opening of one of said first and second pawl-receiving grooves, said actuators being protrusions that project respectively into said notches from said inner peripheral face of said switching ring and that extend axially into said wheel portion, each of said protrusions being slidable circumferentially in one of said notches to push angularly said swingable end of a corresponding one of said first and second pawl plates to said second position.

6. The ratchet screwdriver of claim 1, wherein said shaft further has a rod portion having a cross section smaller than that of said shaft and extending axially toward said tool-coupling portion of said ratchet wheel unit, said rod portion having an annular groove, and a substantially C-shaped ring received in said annular groove, said wheel portion having a first inner peripheral wall, and a second inner peripheral wall having a cross section smaller than that of said first inner peripheral wall and defining an axial hole to receive said rod portion, said teeth being formed circumferentially on said first inner peripheral wall, said second inner peripheral wall having an annular engaging groove communicating with said axial hole to engage said C-shaped ring.

* * * * *